United States Patent [19]

Angell

[11] Patent Number: 4,881,538

[45] Date of Patent: Nov. 21, 1989

[54] RESPIRATOR AIR GUIDE

[75] Inventor: Cyril N. E. Angell, Trowbridge, England

[73] Assignee: Avon Industrial Polymers Limited, Melksham, England

[21] Appl. No.: 894,087

[22] Filed: Aug. 7, 1986

Related U.S. Application Data

[63] Continuation of Ser. No. 773,186, Sep. 6, 1985, abandoned, which is a continuation of Ser. No. 469,894, Feb. 25, 1983, abandoned.

[30] Foreign Application Priority Data

Feb. 26, 1982 [GB] United Kingdom ..... 8205716

[51] Int. Cl.[4] ..... A62B 18/08

[52] U.S. Cl. ..... 128/201.15; 128/201.19; 128/201.25; 128/206.17; 128/206.24

[58] Field of Search ..... 128/201.15, 201.19, 128/201.25, 206.17, 200.28, 206.12, 206.24

[56] References Cited

U.S. PATENT DOCUMENTS

| | | | |
|---|---|---|---|
| 1,410,927 | 3/1922 | Knoblock | 128/201.15 |
| 2,308,991 | 1/1943 | Melup | 128/201.15 |
| 2,821,192 | 1/1958 | Monro | 128/201.15 |
| 2,835,250 | 5/1958 | Austin | 128/201.15 |
| 3,118,445 | 1/1964 | Norman | 128/201.19 |
| 3,181,531 | 5/1965 | Angioletti | 128/201.18 |
| 3,227,159 | 1/1966 | Borgia et al. | 128/201.15 |
| 3,516,404 | 6/1970 | Spross | 128/201.25 |
| 3,667,460 | 6/1972 | Shepard | 128/201.15 |
| 4,186,736 | 2/1980 | Angioletti et al. | 128/201.25 |
| 4,373,520 | 2/1983 | Arbigue | 128/201.19 |
| 4,433,684 | 2/1984 | Sarnoff et al. | 128/206.17 |
| 4,595,003 | 6/1986 | Shoemaker et al. | 128/201.19 |
| 4,764,990 | 8/1988 | Markert | 128/201.15 |

FOREIGN PATENT DOCUMENTS

| | | | |
|---|---|---|---|
| 1028887 | 4/1958 | Fed. Rep. of Germany | 128/201.18 |
| 802211 | 8/1936 | France | 128/201.15 |
| 312594 | 5/1929 | United Kingdom | 128/201.15 |
| 480473 | 2/1938 | United Kingdom | 128/201.15 |

*Primary Examiner*—Max Hindenburg
*Assistant Examiner*—K. M. Reichle
*Attorney, Agent, or Firm*—William R. Hinds

[57] ABSTRACT

Air inhaled into a respirator encounters an air guide positioned inside the face-piece of the respirator which acts as a baffle for the air. The passage between the two contains elongate ridges which are shaped to impede and direct the air and to maintain the spacing of the air guide relative to the face-piece. Because of this, the air guide and face-piece can be made symmetrical, with an air inlet canister and a secondary speech outlet module being applied, in either orientation, to laterally symmetrically disposed apertures in the face-piece.

13 Claims, 2 Drawing Sheets

RESPIRATOR AIR GUIDE

Figure 1:
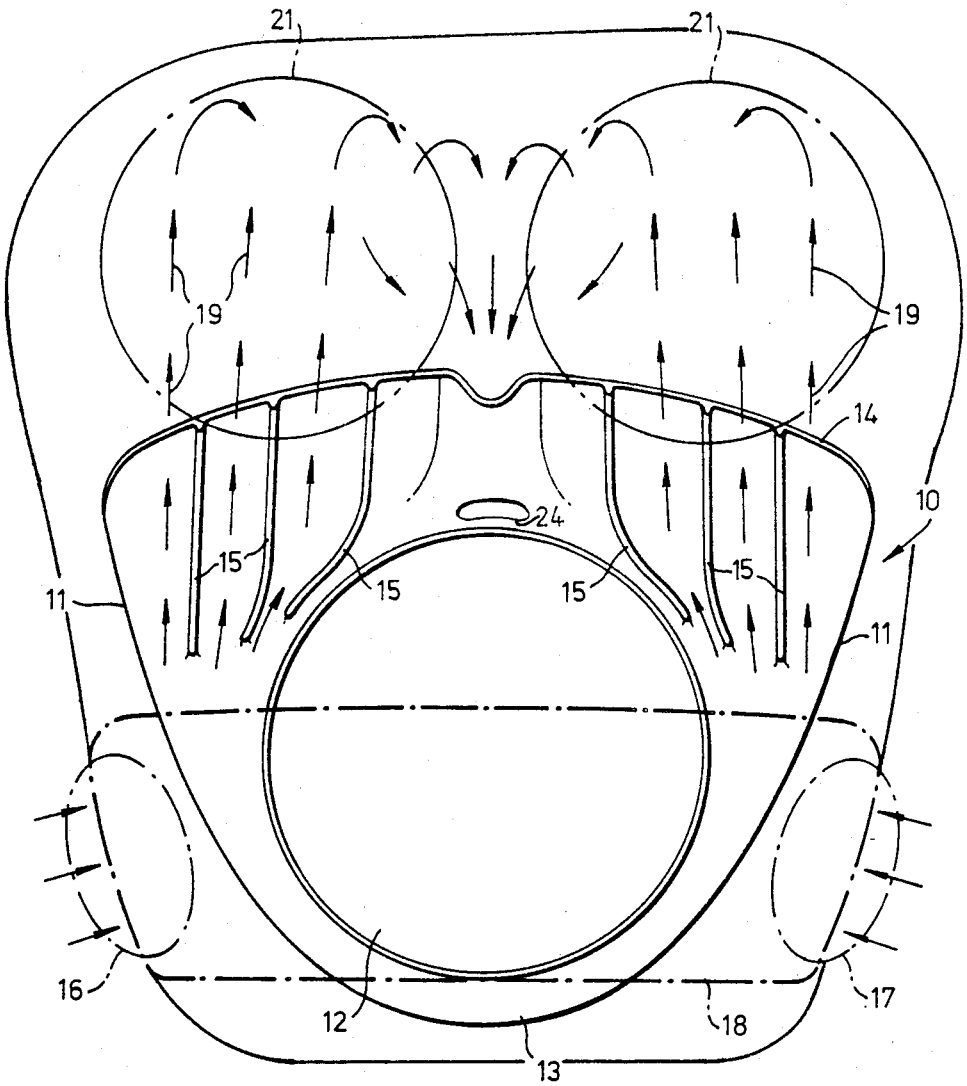

This application is a continuation of application Ser. No. 773,186, filed Sept. 6, 1985, now abandoned, which is a continuation of Ser. No. 469,894, filed Feb. 25, 1983, now abandoned.

FIELD OF THE INVENTION

The present invention relates to a respirator, for use, e.g. in hostile environments, where it is important that air drawn into the face piece of the respirator is free from harmful or pathogenic substances. The respirator has an air guide in the face piece to control the flow of air therein.

BACKGROUND OF THE INVENTION

It is usual for such a respirator to have a filter formed on a canister which is attached to an air-inlet of the face-piece of the respirator. The canister is bulky and it is important that it provides minimum obstruction for the user. Thus depending on the "handedness" of the user the canister is attached on either the right hand side or the left hand side of the face-piece. However, such an arrangement has the problem that the flow of air in the face-piece is assymetric, because of the asymmetric position of the inlet. Prior art attempts have been made to overcome this problem by providing an air guide which, in use, lies between the face-piece and the face of the user. Such an air guide takes the form of an assymetric shield arranged so that air drawn through the inlet orifice(s) to the face-piece has to pass around the air guide to reach the face of the user. However, it has been found that the known air guides do not provide sufficient symmetry of flow, so that cold air drawn into the face-piece passes preferentially over one eye of the user rather than the other thereby affecting vision. An alternative in the prior art has involved the moulding of a closed duct into the thickness of the face-piece, something which presents great manufacturing problems.

SUMMARY OF THE INVENTION

The present invention seeks to overcome these problems associated with the prior art guides and provides a respirator having an air guide with a number of ridges between the air guide and the inner surface of the face-piece of the respirator. The ridges act as vanes to control the direction of air flow over the guide and can be provided on the outer surface of the guide itself and/or on the inner surface of the face-piece, between the face-piece and the guide.

It has been found that the use of such vanes enables the air guide to be made symmetric and yet provide substantially symmetrical air flow in a respirator with an inlet orifice in an assymetric position. Thus the respirator can be made with two orifices, located on opposite sides of the face-piece, such that a filter canister attached to one of the orifices is used depending on the "handedness" of the user. The other orifice may be used to house a secondary speech outlet assembly, the primary speech outlet being provided by a guide on the front of the respirator. This enables a single configuration of respirator face-piece to be used by all, rather than it being necessary to produce left-handed and right-handed respirators, for different users.

The ridges may be shaped so that they provide a number of rectangular air channels extending substantially upwards in the mask. It is believed that such channels act as an impedance to the air passing over the guide, so that air drawn through the inlet towards the mouth passes uniformly through each channel. In this way symmetry of air flow is established.

It is possible to shape the top of the guide so that it directs air away from the face of the user and onto the lenses of the face-piece. This creates a flow of air over the lenses which reduces misting.

DESCRIPTION OF THE DRAWINGS AND OF A PREFERRED EMBODIMENT

Figure 2:
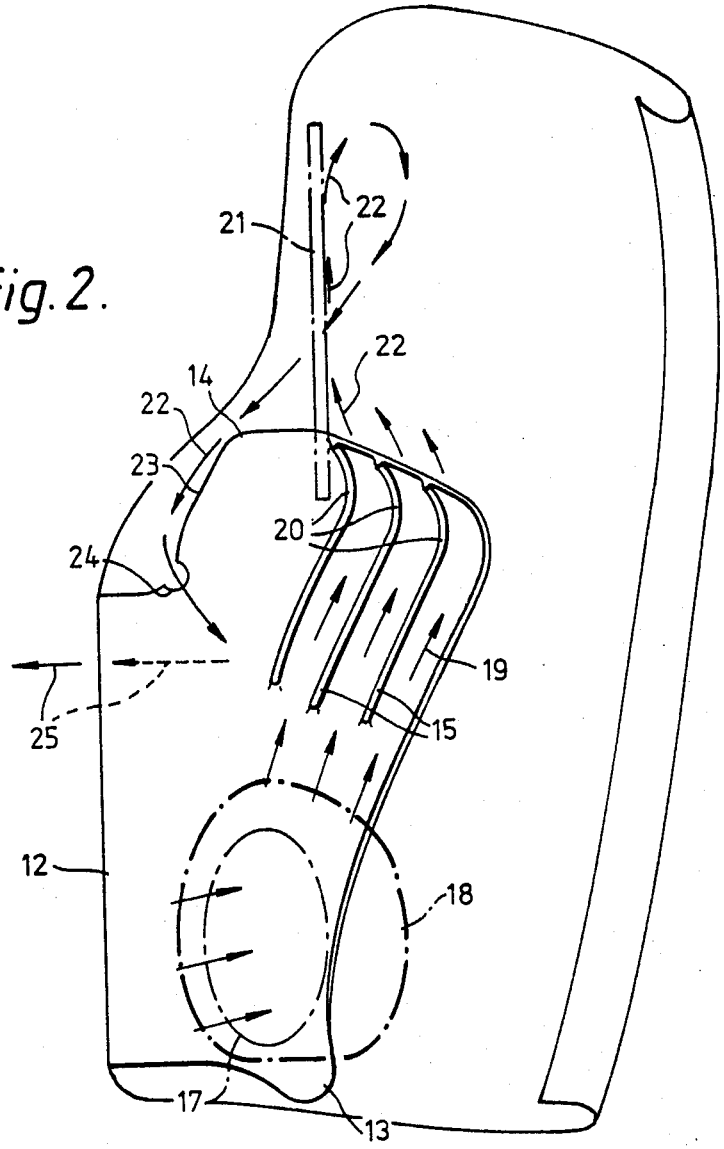

An embodiment of the present invention will now be described in detail, by way of example, with reference to the accompanying drawings, in which:

FIG. 1 is a front view of an air guide and a schematically illustrated face-piece according to the present invention; and FIG. 2 is a side view of the air guide and schematically illustrated face-piece shown in FIG. 1.

Referring first to FIG. 1, an air guide 10 for a respirator comprises a generally triangular member shaped to accommodate the lower part of the human face. The member is generally triangular or shield-shaped in front view and is symmetricl about its centre line on which is also centered an aperture 12. The edge of the aperture 12 is secured to the outlet orifice of the respirator, over which extends a grill which also serves as the primary speech outlet of the respirator. The face-piece of the respirator contacts the air guide along its edge surfaces 11 and 13 leaving a gap between itself and the face-piece in the area between those edges and also along the upper edge 14 of the guide and the adjacent portion of the face-piece. In side view (FIG. 2) the air guide can be seen to have a forwardly projecting part defining the aperture 12 and an inclined upper surface 23 fitting over the nose of the wearer. An aperture 24 through the air guide lies towards the root of this surface 23.

Ridges 15 are provided on the outer surface of the guide between the aperture 12 and the upper edge 14 of the guide 10. They coact with the inner surface of the face-piece, maintaining the spacing of the air guide from the face-piece and are shaped to provide approximately rectangular channels for air along the outer surface of the guide 10. They may be formed by moulding them integrally with the guide 10.

The face-piece is provided with orifices 16,17 on the right hand side and the left hand side. Depending on the "handedness" of the user, a canister containing air-purifying material is attached to the face-piece at one of these orifices (16,17). The other orifice receives an insert to act as a secondary speech outlet.

When the user breathes in, the pressure behind the guide 10 (in the region shown by dotted lines 18) is reduced. This reduction in pressure within the face-piece causes air to be drawn through the canister and the air inlet at orifice 16 or 17. There is in effect a plenum chamber formed between the air guide on the one hand, and the face and under the chin of the user, on the other hand, for which the air is drawn by breathing in. That incoming air passes over the outer surface of the guide 10 until it encounters the ridges 15. These act as vanes to guide the air and to impede its flow in the face-piece so that the air flow shown by arrows 19, is substantially symmetrical on both sides of the respirator, irrespective of whether the air inlet canister is attached to orifice 16 or to orifice 17. As mentioned, the vanes 15 may also assist in maintaining uniform spacing between the guide 10 and the face-piece. This feature is not provided by the standard air guides which may move relative to the face-piece thereby causing the incoming air to flow in an unpredictable way. It is thought that this unpredictable flow is one of the reasons why standard respirators have assymetric airflow within the face-piece, and the present invention seeks to overcome this.

As shown in FIG. 2, the air guide 10 and ridges in the region adjacent the upper edge 14 of the guide 10 have curved portions 20 angled away from the face of the user and towards lenses 21 mounted in the face-piece. As shown by the arrows 22 an air flow is created along the inner surfaces of the lenses 21 and this helps to prevent misting of the lenses 21. The air then passes downwards to the user through aperture 24. Exhaled air is expelled at 25 via aperture 12 to an outlet grill. It is also possible to provide vanes on the inner surface of the face-piece adjacent the lenses 21 which acts as an additional means of guiding air over the lens surfaces.

Contact between the edges 11,13 of the air guide and the inner surface of the face-piece may be assisted by comparatively soft flaps moulded along those edges.

What I claim is:

1. A respirator with a face-piece having an air inlet located asymmetrically relative to a line of said face-piece which is in the median plane of the face of the user, in use, and an air guide connected to said face-piece so as to be positioned, in use, between the air inlet and the face of the user and oriented so as to have its upper edge near but below the eyes of a user, with ridges extending between the face-piece and the air guide and toward the upper edge of the air guide to act as guide vanes and to define channels for directing and improving symmetry of air flow, relative to the median plane, from the asymmetrical air inlet along the surface of the air guide adjacent said face-piece.

2. A respirator according to claim 1, wherein the air guide is symmetrical about the line which is in the median plane of the face of the wearer, in use.

3. A respirator according to claim 2, wherein said ridges are on the air guide and extend symmetrically about the line.

4. A respirator according to claim 3, wherein the face piece has symmetrically arranged apertures one on each side of the line which is in the median plane of the face of the wearer, in use, one of said apertures comprising said air inlet.

5. A respirator according to claim 4, wherein both of the apertures are adapted to receive either of an air purifying insert, to act as the air inlet, and a speech utlet insert, one in one aperture and the other in the other aperture, such that the air inlet is selectively asymmetrically located on either side of the line.

6. A respirator according to claim 1, wherein the face-piece has a major aperture centred on the line which is in the median plane of the face of the wearer, in use, the air guide having a corresponding aperture, the air guide and face-piece being secured together around the margin of the aperture.

7. A respirator according to claim 1, further comprising a lens mounted in the portion of the face-piece adapted to be adjacent the eyes of the user, in use, and wherein an upper edge portion of the air guide and the ridges is directed away from the face of the wearer, in use, to cause air flow towards an inner surface of the lens mounted in the face-piece.

8. A respirator air guide adapted to be secured at the rear inner surface of a face-piece of a respirator having an asymmetrical air inlet, the air guide being substantially inverted isosceles triangular in frontal outline, with a median line bisecting its base, means defining a major aperture bisected by said median line in the apex of the triangle and adapted to be sealed to the face-piece, said air guide having an outer surface for facing, in use, a face-piece to which it is securable and an inner surface for facing the face of a user, and a plurality of ridges on the outer surface of the air guide, at least one such ridge at each side of the median line of the triangle and extending from its mid portion to its base, the ridges being symmetrically disposed in relation to the said line to act as guide vanes and for contacting the surface of the face-piece at least at said base to space the face-piece from the outer surface of the air guide and define therewith restricted air flow passages and spread air flow over the surface of the air guide, for improving symmetry of flow of air admitted, in use, from an asymmetrical inlet to either side of said median line and passing over the said outer surface toward said base.

9. A respirator air guide according to claim 8, wherein the base of the inverted triangle includes a forwardly-curved portion of the said outer surface and of the ridges on that surface.

10. A respirator according to claim 1, wherein the air guide is of generally triangular outline with its base edge uppermost thereby comprising said upper edge and is symmetrical about the line which is in the median plane of the face of the wearer, in use, the face-piece having apertures symmetrically disposed about said line and positioned in front of the air guide and beyond the ends of the ridges relatively adjacent the apex of the triangle, one of which apertures comprises said air inlet, whereby the ridges define symmetrical passages between the upper edge of the air guide and the respective apertures, between the air guide and the face-piece.

11. A generally symmetrical respirator air guide constructed and arranged to be secured at the rear inner surface of a face-piece of a respirator having an asymmetrical air inlet at either of two positions on respective sides of the face-piece, the air guide being generally inverted isosceles triangular in frontal outline, with a median line bisecting its base, a major speech outlet aperture bisected by said median line in the apex of the triangle and adapted to be sealed around the aperture periphery to the face-piece, said air guide having an outer surface for facing, in use, a face-piece to which it is securable and an inner surface for facing the face of a user, said surfaces extending generally rearwardly and outwardly from said major aperture and terminating in upper and side edges generally defining said frontal outline such that a face-piece sealed around said aperture periphery can sealingly engage said side edges and engage said upper base edge to define a substantially continuous air passageway between the outer surface of said air guide and the inner surface of the face-piece and between the periphery of said aperture and said edges of the air guide, such that an air inlet on either respective side of the face-piece will open into the air passageway to permit air flow in all directions in the passageway on both sides of said aperture, and a plurality of ridges on the outer surface of the air guide, at least one such ridge at each side of the median line of the triangle and extending from its mid portion to its upper base edge for contacting the surface of the face-piece at least at said upper base edge to space the face-piece from the outer surface of the air guide and define therewith at least one restricted air flow passage toward said upper base edge at each side of the median line and spread air flow over the surface of the air guide, the ridges being symmetrically disposed in relation to the said median line to act as guide vanes and define comparatively restricted channels between the face piece and said air guide for improving symmetry of flow of air admitted, in use, from an asymmetrical inlet to either side of said median line and passing over the said outer surface toward said upper base edge.

12. A respirator air guide according to claim 11 wherein the upper base edge of the inverted triangle comprises a forwardly-curved portion of the outer surface of the air guide and of the ridges on that surface.

13. A respirator air guide as claimed in claim 11 wherein a forwardly projecting part of said air guide defines said major aperture at its forward end and adjoins at the upper part of its rearward end with a rearwardly and upwardly inclined part of said surfaces which is located to overlie the nose of a wearer, in use, and further comprising an aperture through the air guide in the area of joinder of said projecting part and said inclined part for admitting air flow through the air guide to the face of the user.

* * * * *